US008011957B2

(12) United States Patent
Pan

(10) Patent No.: US 8,011,957 B2
(45) Date of Patent: Sep. 6, 2011

(54) PRESS-FIT MOUNTED ELECTRICAL CONNECTOR

(75) Inventor: Feng Pan, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/715,407

(22) Filed: Mar. 2, 2010

(65) Prior Publication Data

US 2010/0221959 A1 Sep. 2, 2010

(30) Foreign Application Priority Data

Mar. 2, 2009 (CN) ..... 2009 2 0303951

(51) Int. Cl.
*H01R 13/648* (2006.01)

(52) U.S. Cl. ..... 439/607.05; 439/607.1; 439/607.11; 439/941

(58) Field of Classification Search ..... 439/607.05, 439/607.1, 607.11, 941
See application file for complete search history.

(56) References Cited

U.S. PATENT DOCUMENTS 6,146,202 A * 11/2000 Ramey et al. ..... 439/607.1
6,364,710 B1 * 4/2002 Billman et al. ..... 439/607.11
6,371,773 B1 * 4/2002 Crofoot et al. ..... 439/79
6,652,318 B1 11/2003 Winings et al.
6,743,057 B2 6/2004 Davis et al.
6,979,215 B2 * 12/2005 Avery et al. ..... 439/248

* cited by examiner

*Primary Examiner* — Truc T Nguyen
(74) *Attorney, Agent, or Firm* — Ming Chieh Chang; Wei Te Chung; Andrew C. Cheng

(57) ABSTRACT

An electrical connector (100) includes an insulating housing (240) and a number of plate wafers (200) vertically stacked behind the insulating housing (240). Each of the plate wafers (200) includes a frame (22) and a plurality of conductive contacts (23) secured by said frame (22). The conductive contacts (23) of each plate wafer (200) have press-fit portions (236) disposed along a first length. The frame (22) forms a rib (221) extending over the first length along said lower edge of the frame (22) so that a tooling (600) can press on a top face of the rib (221) when the electrical connector (100) is mounted onto the printed circuit board. The insulating housing (240) forms a plurality of engaging portions (244) extending a second length backwardly from the rear face (248) above said rib (221). The second length does not overlap the first length in a vertical direction, so that the tooling (600) can be downwardly inserted between adjacent wafers (200) and press on a top face of the rib (221) of the frame (22).

12 Claims, 3 Drawing Sheets

PRESS-FIT MOUNTED ELECTRICAL CONNECTOR

BACKGROUND OF THE INVENTION

1. Field of the invention

The present invention relates to an electrical connector, and more particularly to an electrical connector press-fit mounted onto a printed circuit board.

2. Description of Related Art

U.S. Pat. No. 6,743,057 issued to Davis et al. on Jun. 1, 2004 discloses a backplane connector with a plurality of signal modules stacked therein. Ground shields are interleaved between adjacent signal modules. The signal modules include signal traces that may, or may not, be arranged in differential pairs and mating faces configured to join a mating connector and a PCB. The signal modules include a notch formed in at least one edge. The notches align with one another to form a channel that receives a cross-link that reduces relative movement between signal modules. The cross-link may be a flat bar having a series of cutouts that are slidably received by the signal modules. The electrical connector may include one or more cross-links. Optionally, the cross-link may be made of a conductive material and engage the ground shields, thereby electrically interconnecting the ground shields. The signal traces are formed of conductive contacts and have press-fit portion for mating with a plurality of conductive holes formed in the PCB.

However, when the connector is to be mounted onto the PCB, a tooling applies a force on the topmost face of the connector which is far from the press-fit portion, which increases the instability of the mounting process.

SUMMARY OF THE INVENTION

An object of the present invention is to provide an electrical connector having a feature to be pressed on when the electrical connector is press-fit mounted onto a printed circuit board.

An electrical connector to be mounted on a printed circuit board, comprises an insulating housing and a plurality of plate wafers vertically stacked behind the insulating housing. Said insulating housing defines a front face and an opposite rear face, a plurality of contact receiving slots extending there through. Each of the plate wafers comprises a frame and a plurality of conductive contacts secured by said frame. The plurality of conductive contacts of the plate wafer are planarly arrayed. Each of the conductive contacts forms a mating portion forwardly extending into said insulating housing, a middle portion secured in said frame and a press-fit portion extending downwardly from a lower edge of the frame. The press-fit portions of said plurality of conductive contacts of each wafer are disposed along a first length. The frame forms a rib extending over the first length along said lower edge of the frame so that a tooling can press on a top face of the rib when the electrical connector is mounted onto the printed circuit board. The insulating housing forms a plurality of engaging portions extending a second length backwardly from the rear face above said rib. The second length does not overlap the first length in a vertical direction.

According to another aspect of the present invention, an electrical connector is provided. The electrical connector is used to be mounted on a printed circuit board, and comprises a plurality of plate wafers vertically stacked and an insulating housing. Each wafer comprises a frame and a plurality of conductive contacts planarly arrayed and secured by said frame. Each of said conductive contacts forms a mating portion extending forwardly to mate with a complementary mating connector, a middle portion secured in said frame and a press-fit portion extending downwardly from a lower edge of the frame. The press-fit portions of said plurality of conductive contacts of each wafer disposed along a first length. The frame forms a rib extending a first length along said lower edge of the frame. The insulating housing defining a front face and an opposite rear face, a plurality of contact receiving slots, and a plurality of engaging portions for securing said plurality of plate wafers. The plurality of engaging portions extend along a second length backwardly from the rear face above said rib of said frame. The second length does not overlap the first length in a vertical direction, so that a tooling can be downwardly inserted between adjacent wafers and press on a top face of the rib of the frame.

Other objects, advantages and novel features of the invention will become more apparent from the following detailed description of a preferred embodiment when taken in conjunction with the accompanying drawings.

DETAILED DESCRIPTION OF THE INVENTION

Figure 1:
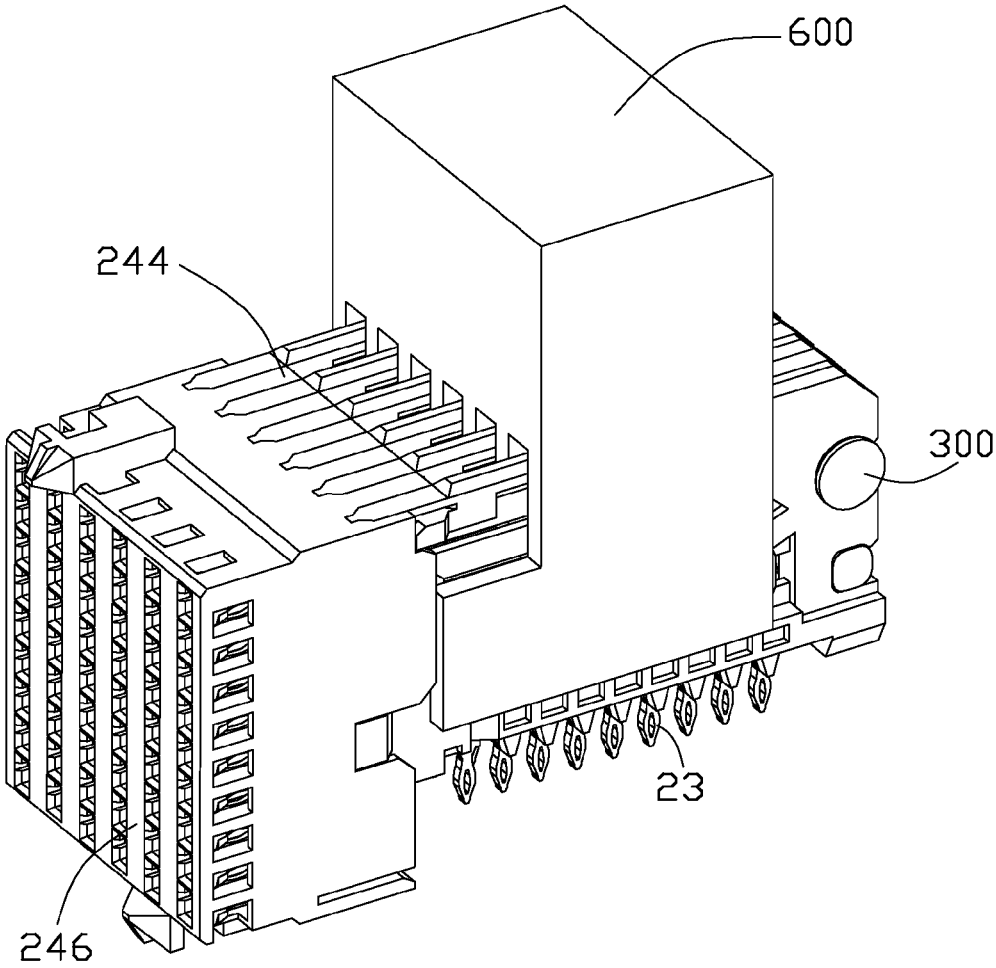
FIG. 1 is a perspective view of an electrical connector according to an embodiment of the present invention and a tooling for mounting the electrical connector onto a printed circuit board.

Reference will now be made to the drawing figures to describe the present invention in detail.

Figure 2:
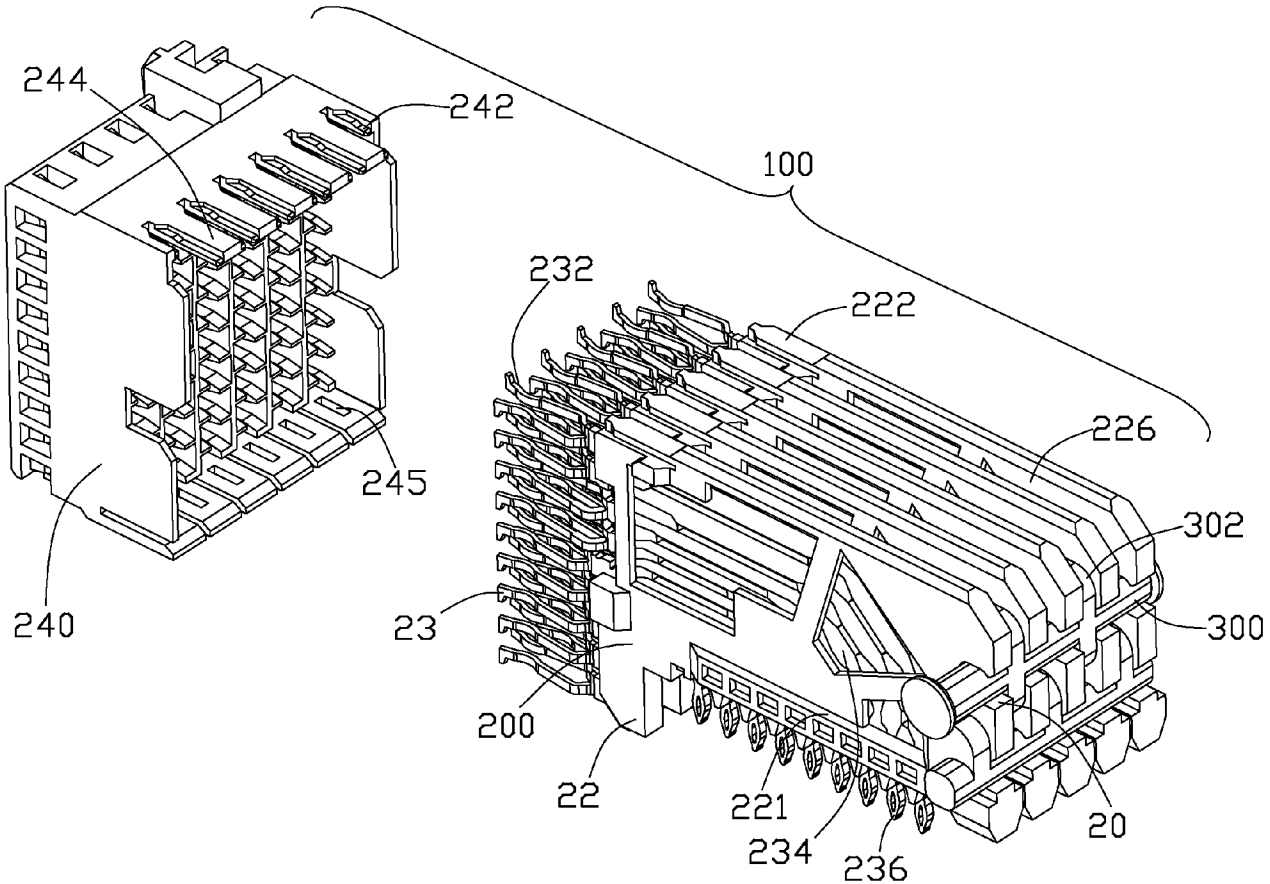
FIG. 2 is a perspective view of the electrical connector with a front insulating housing separated from a plurality of vertical plate wafers shown in FIG. 1.
Figure 3:
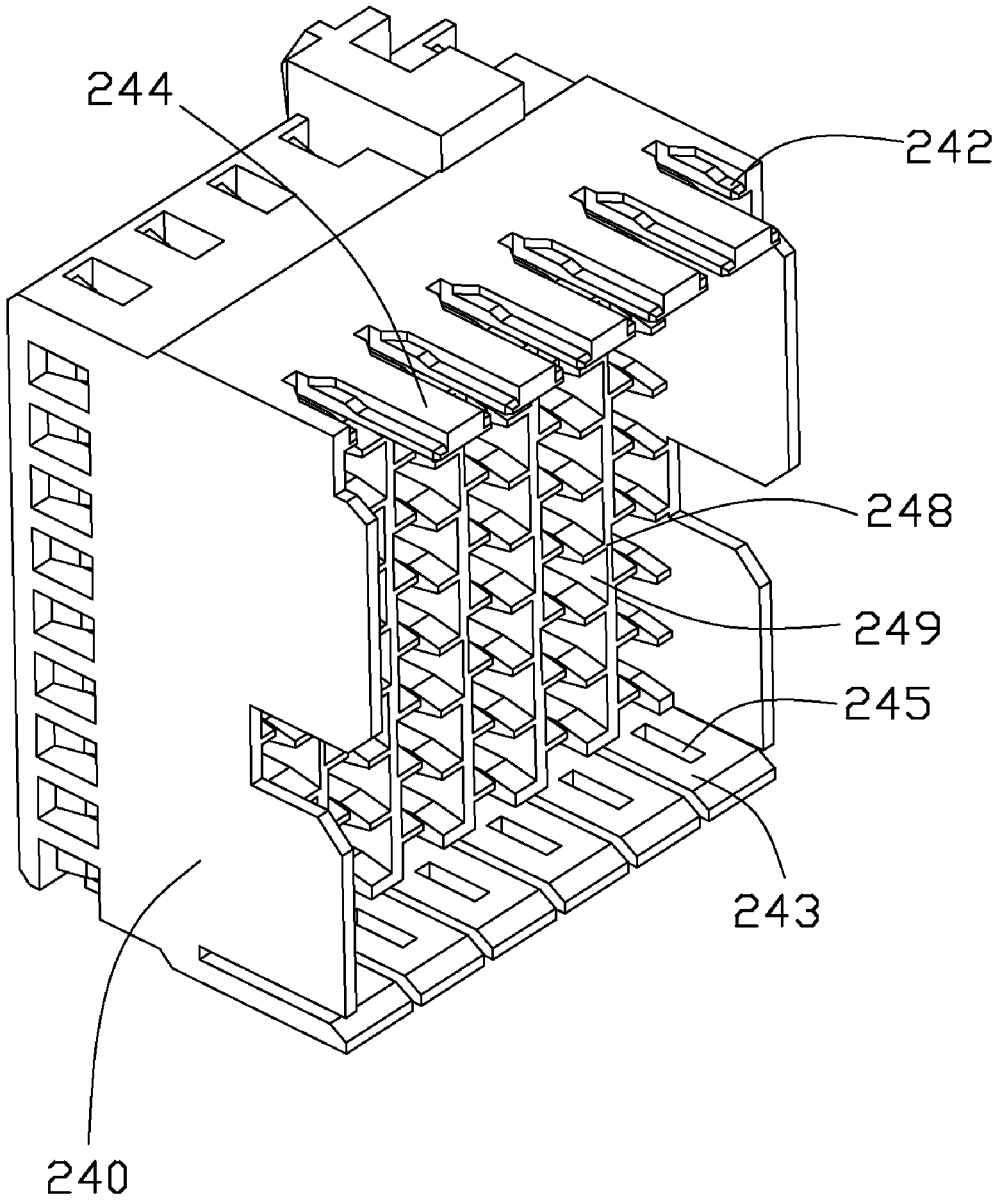
FIG. 3 is a perspective view of the front insulating housing shown in FIG. 2.

Referring to FIGS. 1-3, an electrical connector 100 according to an embodiment of the present invention is shown. The electrical connector 100 is used to mate with a complementary mating connector (not shown) and be mounted onto a printed circuit board (not shown), thereby electrically connecting the complementary mating connector to the printed circuit board.

The electrical connector 100 comprises an insulating housing 240 and a plurality of plate wafers 200 vertically stacked behind the insulating housing 240. The insulating housing 240 defines a front face 246 and an opposite rear face 248, a plurality of contact receiving slot 249 extending there through. Each of the plate wafers 200 comprises a frame 22 and a plurality of conductive contacts 23 secured by said frame 22. The plurality of conductive contacts 23 are planarly arrayed. Each of the conductive contacts 23 forms a mating portion 232 forwardly extending into said insulating housing 24, a middle portion 234 secured in said frame 22 and a press-fit portion 236 extending downwardly from a lower edge of the frame 22. The press-fit portions 236 of said plurality of conductive contacts 23 of each wafer 200 are disposed along a first length. The frame 22 forms a pair of ribs 221 respectively on opposite sides of associated plate wafer 200, the pair of ribs 221 extending a first length along said lower edge of the frame 22 so that a tooling 600 can press on a top face of the rib 221 when the electrical connector 100 is to be mounted onto the printed circuit board. The insulating housing 240 forms a plurality of engaging portions 244 extending a second length backwardly from the rear face 248 at a level higher than the pair of ribs 221. The second length does not overlap the first length in a vertical direction, so that the tooling 600 can be downwardly inserted between adjacent wafers 200 and press on a top face of the rib 221 of the frame 22.

The electrical connector 100 further comprises two positioning bars 300. The stacked plate wafers 200 form two rows of slots 20 parallely aligned in a horizontal direction perpendicular to said plate wafers 200. The two positioning bars 300 are respectively inserted into the two rows of slots 20 thereby defining the position of the plate wafers 200 perpendicular to the positioning bars 300. The two positioning bars 300 form a plurality of teeth 302 extending parallely to said plate wafers 200 and interposed between adjacent two of said plate wafers 200, thereby defining the position of the plate wafers 200 along the positioning bars 300. The engaging portions 244 forms a plurality of guiding beams 244 and a plurality of guiding slots 242 therebetween, said plate wafers 200 form guiding edges 222 received in corresponding guiding slots 242. The teeth 302 and the guiding slots 242 have proper pitches to keep the plate wafers 200 in position so a slot 226 for receiving the press tooling 600 is defined between said adjacent two of said plate wafers 200 above the rib 221 of corresponding frame 22.

The insulating housing 240 forms a plurality of flexible arm 243 under each plate wafer 200, each of said flexible arm 243 defining a recess 245 opening upwardly for mating with corresponding plate wafer 200 thereby latching the plate wafer 200 in position along a front-to-rear direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector to be mounted on a printed circuit board, comprising:

an insulating housing defining a front face and an opposite rear face, a plurality of contact receiving slot extending through the front and rear face;

a plurality of plate wafers vertically stacked behind the insulating housing, each wafer comprising a frame and a plurality of conductive contacts secured by said frame, the plurality of conductive contacts planarly arrayed and each having a mating portion forwardly extending into said insulating housing, a middle portion secured in said frame and a press-fit portion extending downwardly from a lower edge of the frame, the press-fit portions of said plurality of conductive contacts of each wafer disposed along a first length, said frame forming a rib extending over the first length along said lower edge of the frame for a tooling to press on a top face of the rib;

a cylindrical positioning bar;

wherein said insulating housing forming a plurality of engaging portions extending a second length backwardly from the rear face at a level higher than said rib, said second length not overlapping the first length in a vertical direction;

wherein each of the plate wafers forming a slot within a region of the rib;

wherein the slot of each plate wafer aligned in a horizontal direction;

wherein the cylindrical positioning bar inserted into the slots.

2. An electrical connector according to claim 1, wherein the positioning bar forms a plurality of teeth extending parallel to said plate wafers and interposed between adjacent two of said plate wafers, said teeth and said engaging portions of the insulating housing keep the plate wafers in position so a slot is defined between said adjacent two of said plate wafers and above the rib of an associated frame.

3. An electrical connector according to claim 2, wherein each of the frames forms a pair of said ribs respectively on opposite sides of associated plate wafer.

4. An electrical connector according to claim 1, wherein said engaging portions form a plurality of guiding beams and a plurality of guiding slots therebetween, and said plate wafers form guiding edges received in corresponding guiding slots.

5. An electrical connector according to claim 4, wherein said insulating housing forms a plurality of flexible arms each under a respective plate wafer, each of said flexible arms defining a recess opening upwardly for mating with corresponding plate wafer.

6. An electrical connector to be mounted on a printed circuit board, comprising:

a plurality of plate wafers vertically stacked, each wafer comprising a frame and a plurality of conductive contacts planarly arrayed and secured by said frame, each of said conductive contacts having a mating portion extending forwardly to mate with a complementary mating connector, a middle portion secured in said frame and a press-fit portion extending downwardly from a lower edge of the frame, the press-fit portions of said plurality of conductive contacts of each wafer disposed along a first length, said frame forming a rib extending a first length along said lower edge of the frame;

an insulating housing defining a front face and an opposite rear face, a plurality of contact receiving slots, and a plurality of engaging portions for securing said plurality of plate wafers, said plurality of engaging portions extending along a second length backwardly from the rear face above said rib of said frame;

a cylindrical positioning bar;

wherein said second length does not overlap the first length in a vertical direction, the rib of the frame forming a top face on which a tooling downwardly press;

wherein each of the plate wafers forming a slot within a region of the rib;

wherein the slot of each plate wafer aligned in a horizontal direction;

wherein the cylindrical positioning bar inserted into the slots.

7. An electrical connector according to claim 6, further comprising two positioning bars, wherein the plate wafers forming two lines of slots parallely aligned in a horizontal direction, the positioning bars inserted into the slots.

8. An electrical connector according to claim 7, wherein the positioning bar forms a plurality of teeth extending parallel to said plate wafers and interposed between adjacent two of said plate wafers, said teeth and said engaging portions of the insulating housing keep the plate wafers in position so a slot is defined between said adjacent two of said plate wafers and above the rib of an associated frame.

9. An electrical connector according to claim 8, wherein each of the frames forms a pair of said ribs respectively on opposite sides of associated plate wafer.

10. An electrical connector according to claim 6, wherein said engaging portions form a plurality of guiding beams and a plurality of guiding slots therebetween, and said plate wafers form guiding edges received in corresponding guiding slots.

11. An electrical connector according to claim 10, wherein said insulating housing forms a plurality of flexible arms each under a respective plate wafer, each of said flexible arms defining a recess opening upwardly for mating with corresponding plate wafer.

12. An electrical connector to be mounted on a printed circuit board, comprising:

an insulating housing defining a front face and an opposite rear face, a plurality of contact receiving slot extending through the front and rear face in a front-to-back direction;

a plurality of plate wafers vertically stacked behind the insulating housing, each wafer comprising a frame and a plurality of conductive contacts secured by said frame, the plurality of conductive contacts planarly arrayed and each having a mating portion forwardly extending into said insulating housing, a middle portion secured in said frame and a press-fit portion extending downwardly from a lower edge of the frame, the press-fit portions of said plurality of conductive contacts of each wafer disposed along a first length, said frame forming a lower rib extending over the first length along said lower edge of the frame for a tooling to press on a top face of the lower rib;

said insulating housing forming a plurality of upper engaging portions extending a second length backwardly from the rear face at a level higher than said rib and engaged with an upper portion of the corresponding plate wafers;

a cylindrical positioning bar;

wherein said upper engaging portions are offset from the lower ribs of the corresponding plate wafers in said front-to-back direction;

wherein each of the plate wafers forming a slot within a region of the rib;

wherein the slot of each plate wafer aligned in a horizontal direction;

wherein the cylindrical positioning bar inserted into the slots.

* * * * *